US006390451B1

(12) United States Patent
Baker

(10) Patent No.: US 6,390,451 B1
(45) Date of Patent: May 21, 2002

(54) DEVICE AND METHOD FOR LIFTING A SECTION OF A VEHICLE

(76) Inventor: Wayne F. Baker, Richland Meadows Trailer Park, 232 Yankee Rd., Lot #326, Cedar Dr., Richland, PA (US) 18951

( * ) Notice: Subject to any disclaimer, the term of this patent is extended or adjusted under 35 U.S.C. 154(b) by 0 days.

(21) Appl. No.: 09/845,229

(22) Filed: May 1, 2001

(51) Int. Cl.[7] ..... B66F 7/22

(52) U.S. Cl. ..... 254/94; 254/4 R; 254/4 B; 254/2 B; 254/426

(58) Field of Search ..... 254/94, 4 R, 4 B, 254/2 B, 47, 426, 133 A, 133 R, DIG. 9

(56) References Cited

U.S. PATENT DOCUMENTS 3,578,353 A * 5/1971 Lockhart ..... 254/94
3,873,118 A * 3/1975 Takagi ..... 254/94
6,077,023 A * 6/2000 Troppman, III ..... 254/4 R

* cited by examiner

*Primary Examiner*—Joseph J. Hail, III
*Assistant Examiner*—Lee Wilson
(74) *Attorney, Agent, or Firm*—LaMorte & Associates

(57) ABSTRACT

A device and method is claimed for elevating a vehicle. The jack device has a frame with a first section and a second section that are joined together at a hinged connection. The first section and second section of the frame are supported by wheels. A spool is coupled to at least one of the wheels. A flexible element extends from the spool to an opposite point on the frame that is across the hinged connection. The flexible element winds around the spool and pulls the first section and the second section together while being wound. A support platform is carried by the frame and is elevated as the first section of the frame and the second section of the frame move toward each other.

16 Claims, 3 Drawing Sheets

DEVICE AND METHOD FOR LIFTING A SECTION OF A VEHICLE

BACKGROUND OF THE INVENTION

1. Field of the Invention

In general, the present invention relates to jacks and similar elevation devices that are used to elevate a section of a vehicle for the purpose of changing a tire.

2. Prior Art Statement

There exist many situations where it is desirable to elevate a portion of an automobile. Many of those situations are encountered by mechanics whose job it is to repair and maintain vehicles. However, the situation that is most encountered by the average vehicle driver, is when the vehicle has a flat tire and the tire must be changed.

Most all vehicles come equipped with some form of mechanical jack and a spare or temporary tire. If a vehicle has a flat tire, this equipment enables a person to elevate the vehicle near the flat tire, and replace the flat tire. In the prior art record, a large variety of mechanical jacks have been developed. Most modern vehicles come equipped with either a piston jack device, a scissor jack device or a ratchet jack device. A piston jack device is a mechanical/hydraulic jack device that includes a collapsible hydraulic piston that is placed under a vehicle. A rod is then used to turn a screw at the base of the piston. The turning of the screw is used to create hydraulic pressure in the piston that causes the piston to expand and lift the vehicle. The disadvantages of piston jacks are that they have a limited lifting height, they are difficult to place under the frame of a vehicle and they are hard to operate when in place under a vehicle.

Scissor jack devices are mechanical jacks, where a screw is used to close a set of linkages arranged in a scissor configuration. As the screw is turned, the linkages close and the length of the scissor jack expands. The disadvantages of scissor jacks are that they tip easily, they are difficult to place under the frame of a vehicle and they also are hard to operate when in place under a vehicle.

Ratchet jack devices are mechanical jacks where a lifting hook is advanced on a vertical shaft with a ratchet mechanism. Ratchet jacks are easier to operate than are piston jacks and scissor jacks. However, ratchet jacks cannot be placed under a vehicle. Rather, they must be attached to an exterior portion of the vehicle, such as a bumper. As such, ratchet jacks cannot be used on many modern automobiles that have plastic bumpers that are incapable of supporting the weight of the vehicle.

Since ratchet jacks cannot be used with many modern automobiles, these automobiles typically come equipped with either a piston jack or a scissor jack. As has been previously mentioned, both of these types of jacks are difficult to set into place and operate. In both cases, the jack must be placed between the ground and the vehicle at some point under the vehicle. This often requires a person to lie on the ground to properly position the jack. Once positioned, a person must typically kneel or sit on the ground to operate the jack. Accordingly, the task of simply using a vehicle jack is a task that is beyond the ability of many people and is highly inconvenient for most others.

In an attempt to improve the ease of using a jack, many jacking devices have been invented that do not require a person to manually operate the jack. For instance, in the prior art record, there are many hydraulic jack devices that are manufactured as part of a vehicle. These jacks are always in place and can be operated with the switch of a lever within the automobile. However, such jack devices are extremely expensive and cannot be added to existing vehicles in a cost effective manner.

The prior art record also contains electric jacks that are placed under vehicles and are operated using power from the cigarette lighter of the vehicle. Such electric jacks are also very expensive as compared to manually operated jacks.

Other types of jacks that exist in the prior art are jacks that convert forward movement of an automobile into an elevating force. With this kind of jack, a tiltable framework is placed under the vehicle. The vehicle is then moved forward. As the vehicle moves forward, the framework tilts and a portion of the vehicle is elevated by the framework. Such prior art jack devices tend to be large, expensive and only work in limited situations. As such, they are typically owned by automobile repair shops and are not carried in a vehicle to change a flat tire.

A need therefore exists for a new type of low cost jack device that has a greatly simplified method of installation and operation. In this manner, people previously incapable of jacking up their vehicle can do so in a manner that is convenient, simple and not highly physically intensive. This need is met by the present invention jack assembly as described and claimed below.

SUMMARY OF THE INVENTION

The present invention is a jack device and its associated method of elevating a vehicle. The jack device includes an elongated shaft having a first end and a second end. At least one front wheel is supported by the first end of the shaft. A platform is connected to the opposite second end of the shaft. It is the platform that contacts and lifts the underside of a vehicle. To elevate the platform at the second end of the shaft, a frame structure is connected to the shaft with a hinged connection. The frame structure supports at least one rear wheel.

A spool is connected to at least one of the wheels supporting the jack device. A flexible element extends from the spool. The flexible element extends across the hinged connection between the shaft and the frame structure. As the jack assembly is moved forward, the wheels turn and the spool turns. As the spool turns, the flexible element winds around the spool and becomes taut. This pulls the frame structure toward the shaft, thereby elevating the lifting shaft and the platform at the end of the shaft.

To utilize the jack device, the jack device is placed under a vehicle. The platform of the jack device is then engaged with the frame of the vehicle. The vehicle is then moved forward. As the vehicle moves forward, the jack device rolls forward. This causes the jack device to elevate the platform and lift the vehicle. To lower the vehicle, the vehicle is placed in a neutral gear and is pushed backwards. This causes the jack device to roll in reverse, thereby lowering the platform.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention jack assembly can be used to elevate most any type of motor vehicle, the present invention jack assembly is particularly well suited for elevating a passenger car. As such, by way of example, the technology of the present invention is illustrated and described as being configured as a portable jack assembly for a passenger car in order to set forth one of the best modes contemplated for the invention.

Figure 1:
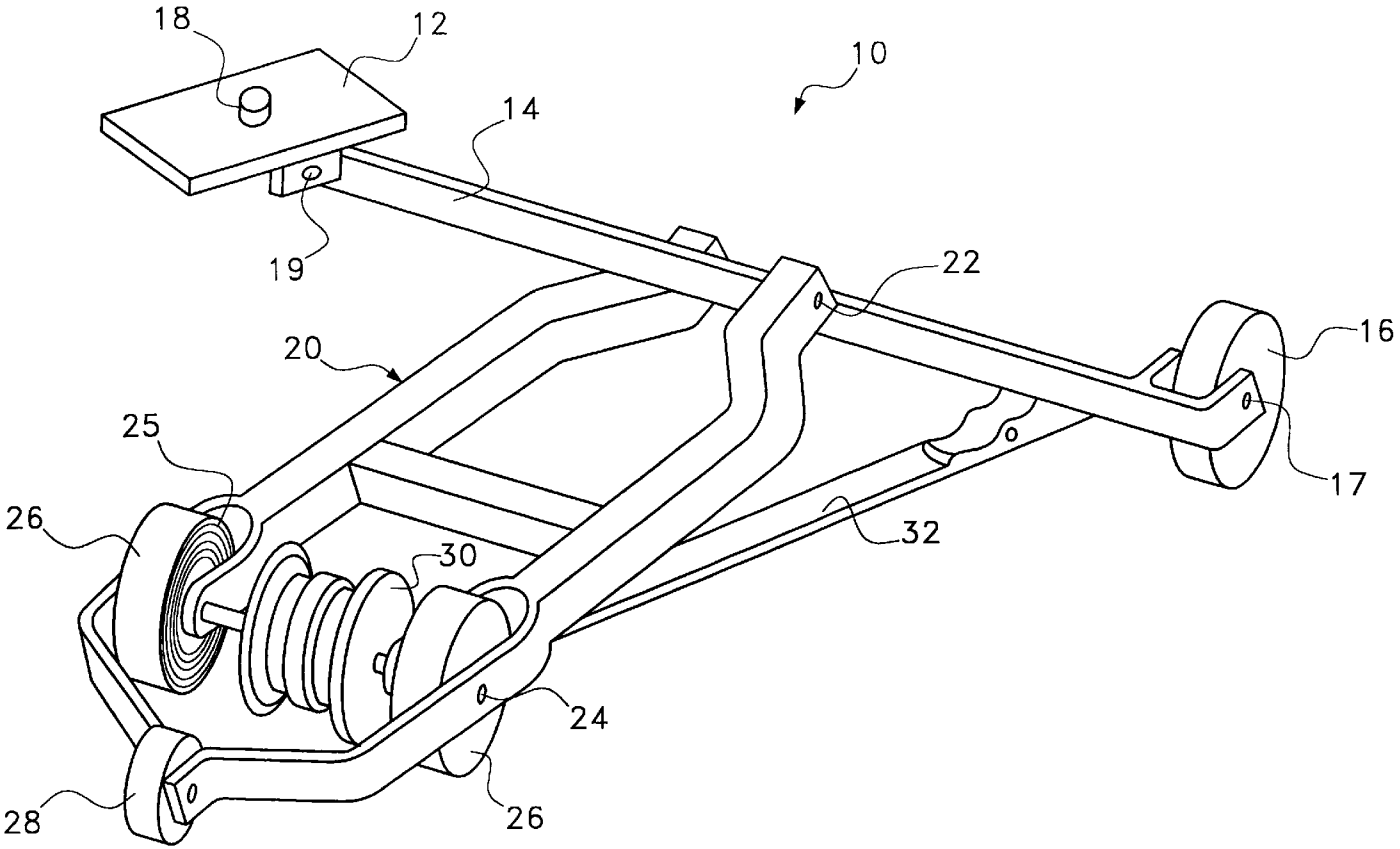
FIG. 1 is a perspective view of an exemplary embodiment of a jack device shown in accordance with the present invention.

Referring to FIG. 1, an exemplary embodiment of a jack assembly 10 is shown in accordance with the present invention. The jack assembly 10 is designed to be placed under a vehicle and rolled forward. As the jack assembly 10 is rolled forward, the platform 12 at the top of the jack assembly 10 rises. Once the platform 12 engages an automobile, the automobile is then either pushed forward or moved forward using its own power. As the automobile moves forward, the jack assembly 10 rolls forward with the automobile and the platform 12 continues to rise. At some point, the platform 12 of jack assembly 10 rises to a height that elevates a section of the automobile off the ground. To lower the platform 12, the automobile is placed in a neutral gear and is pushed in backward. As the automobile moves backward, the jack assembly 10 rolls in reverse and the platform 12 on the jack assembly 10 descends.

The jack assembly 10 contains a primary lifting shaft 14. The primary lifting shaft 14 is made of steel or another strong metal alloy, since it is the primary lifting shaft 14 that bears most of the weight of a vehicle. The primary lifting shaft 14 has two ends. At the bottom end of the primary lifting shaft 14 is at least one front wheel 16. The front wheel, or wheels, 16 are coupled to an axle 17 and are free to rotate. In the shown embodiment, the bottom end of the primary lifting shaft 14 has a forked configuration and supports a single wheel 16. It should be understood that this configuration is merely exemplary and can be changed to support two wheels or any plurality of wheels.

The support platform 12 is attached to the top end of the primary lifting shaft 14. The support platform 12 is coupled to the primary lifting shaft 14 by a pivot 19. As such, the support platform 12 is free to move about the pivot 19 independently from the primary lifting shaft 14. An engagement device 18 is present on the top of the support platform 12. The purpose of the engagement device 18 is to create a mechanical interconnection between the support platform 12 and the frame of the vehicle, as will later be explained.

One end of a rigid frame structure 20 is joined to the primary lifting shaft 14 with a hinged connection 22. The hinged connection 22 is located at a point between one third and one half the way up the length of the primary lifting shaft 14, as measured from its bottom end. The rigid frame structure 20 supports a rear axle 24, wherein the rear axle 24 is free to rotate independently of the rigid frame structure 20.

Two rear wheels 26 are connected to the rear axle 24. The rear wheels 26 are affixed to the axle 24 so that the rear wheels 26 cannot turn independently from the axle 24. A smaller limiting wheel 28 is also supported by the rigid frame structure 20 behind the rear wheels 26. The purpose of the limiting wheel 28 will later be explained.

A spool 30 is connected to the axle 24 in between the two rear wheels 26. The spool 30 is also firmly affixed to the axle 24 so that the spool 30 cannot turn independently from the axle 24. A flexible element 32 is wound around the spool 30. One end of the flexible element 32 is connected to the spool 30. The opposite end of the flexible element 32 is coupled to the primary lifting shaft 14 at a point proximate the bottom end of the primary lifting shaft 14. The flexible element 32 can be a nylon strap, a chain, a cable or any other flexible structure having the ability to support a high tensile force.

At least one spring 25 is provided that engages either the rear wheels 26 or the axle 24. The energy is stored on the spring as the rigid frame structure 20 and the primary lifting shaft 14 are spread apart and the support platform 12 lowered. As such, the spring 25 acts to turn the rear wheels 26 in a forward direction. This keeps the flexible element 32 taut on the spool 30. The spring also causes the support platform to automatically rise and meet the bottom of a vehicle when placed under that vehicle.

Figure 2:
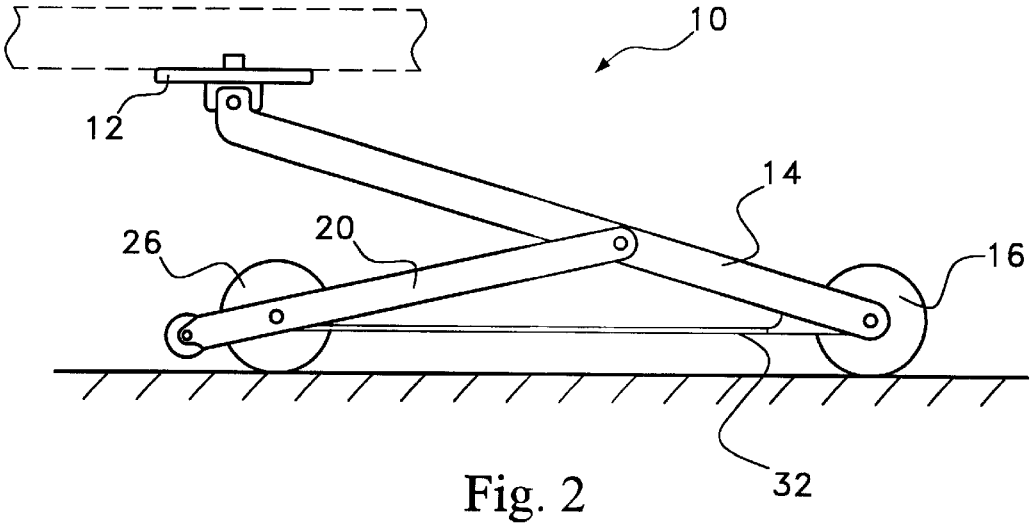
FIG. 2 is a side view of the embodiment of FIG. 1, shown in a retracted configuration under a section of a vehicle.

Referring now to FIG. 2, it will be understood that when the jack device 10 is not in use, the spring 25 (FIG. 1) stores little energy until the support platform 12 is depressed down to a height that can be placed under a vehicle. As the support platform is depressed, the rigid frame structure 20 and the primary lifting shaft 14 spread. This causes the pool 30 to unwind, thereby turning and storing energy in the spring 25. As the front wheel 16 on the primary lifting shaft 14 spread away from the two rear wheels 26 on the rigid frame structure 20, the angle between the primary lifting shaft 14 and the rigid frame structure 20 becomes obtuse. This also causes the flexible element 32 to unwind from the spool 30 (FIG. 1) and extend to its greatest length. Once at this configuration, the height of the support platform 12 above the plane of the wheels 16, 26 is at a minimum and is preferably under six inches.

When a vehicle needs to be elevated, the jack device 10 is placed in the space under the vehicle between the frame of the vehicle and the ground. Due to the spring 25, the support platform 12 automatically rises to engage the bottom of the vehicle in the area of the vehicle that is to be elevated. Once the jack device 10 is in place, the vehicle is then rolled forward. The vehicle can be pushed forward or can be driven forward under its own power.

Figure 3:
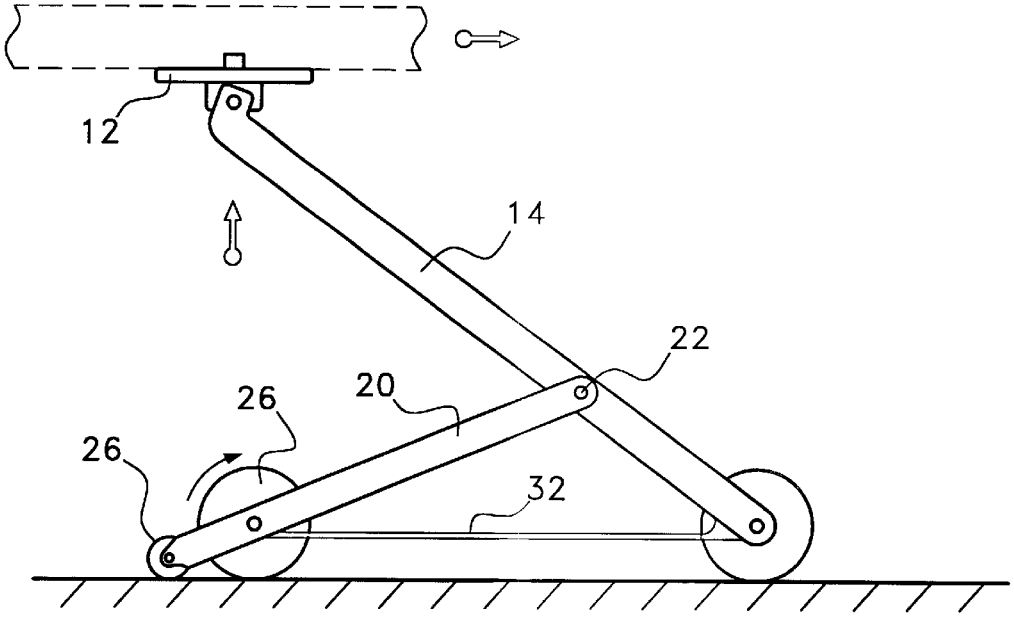
FIG. 3 is a side view of the embodiment of FIG. 1, shown in an extended configuration under a section of a vehicle.

Referring to FIG. 3, it can be seen that as the vehicle is moved forward, the jack device 10 rolls forward along the ground. As the jack device 10 rolls forward, the flexible element 32 winds around the spool 30 (FIG. 1). As the flexible element 32 winds around the spool, a tension force is created in the flexible element 32 that acts to pull the two rear wheels 26 toward the bottom end of the primary lifting shaft 14. As the contracting tension force of the flexible element 32 surpasses the opposing expanding force, created by the weight of the vehicle, the rigid frame structure 20 pivots around the hinged connection 22, and the angle between the rigid frame structure 20 and the primary lifting shaft 14 decreases. As the angle decreases, the primary lifting shaft 14 is pushed toward the vertical. The result is that the height of the support platform 12 above the plane of the wheels 16, 26 is increased. When the support platform 12 is lifted to a height greater than the space available under the vehicle, the jack device 10 elevates the vehicle.

As the flexible element 32 winds around the spool, the tension force in the flexible element 32 pulls the rigid frame structure 20 toward a vertical orientation. When the flexible element 32 pulls the rigid frame structure 20 toward a vertical orientation, the rigid frame structure 20 elevates the primary lifting shaft 14 to its highest angle and the jack device 10 to its maximum elevation. To prevent the rigid frame structure from rotating beyond a vertical orientation, a limiting wheel 28 is provided. The limiting wheel 28 is oriented so that it first contacts the ground as the rigid frame structure 20 approaches a vertical orientation. Before the rigid frame structure 20 reaches a vertical orientation, the limiting wheel 28 lifts the two rear wheels 26 off the ground. Consequently, the rear wheels 26 no longer rotate along the ground and stop the rigid frame structure 20 from being over rotated.

After work on the elevated vehicle is complete, the vehicle is rolled backwards. As the vehicle moves backwards, the jack device 10 rolls backward. As the jack device 10 rolls backward, the flexible element 32 unrolls from the spool 30 (FIG. 1) and the length of the exposed flexible element 32 increases. This enables the rigid frame structure 20 to rotate away from the vertical and enables the support platform 12 to descend. Once the weight of the vehicle is no longer supported by the jack device 10, the jack device 10 can be removed from under the vehicle.

Figure 4:
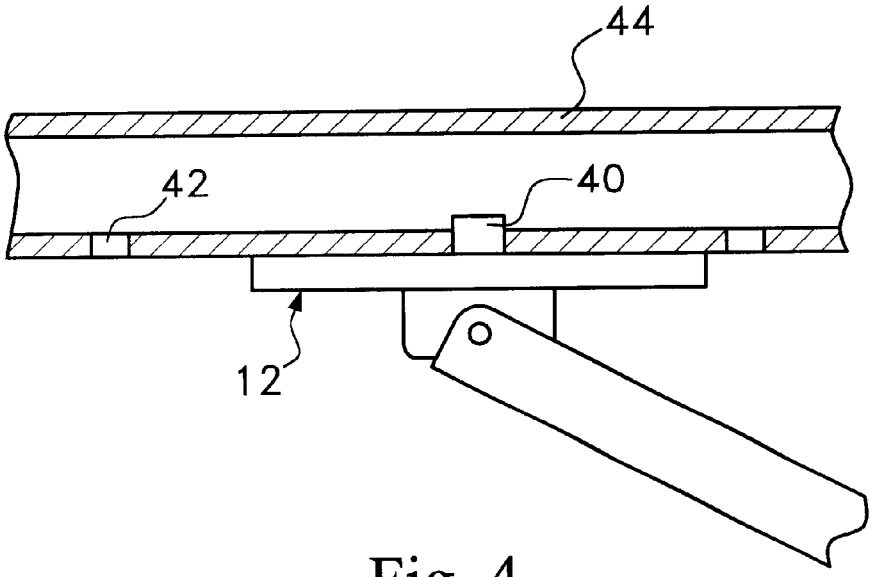
FIG. 4 is a fragmented view of one preferred embodiment of the support platform section of the present invention.

Referring now to FIG. 4, a first embodiment of the support platform 12 is shown. In this embodiment, a small peg 40 extends upwardly from the support platform 12. Holes 42 are present in the frame 44 of the vehicle being elevated. The peg 40 is placed into one of the holes 42, thereby interconnecting the support platform 12 to the vehicle and preventing the vehicle from moving forward or backward without the support platform 12.

Figure 5:
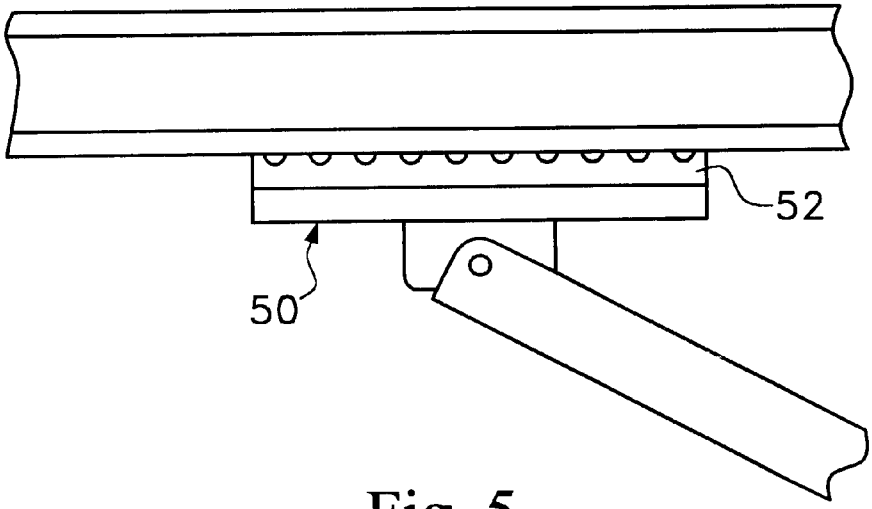
FIG. 5 is a fragmented view of an alternate embodiment of the support platform section of the present invention.

Referring to FIG. 5, an alternate embodiment of the support platform 50 is shown. In this embodiment, a large textured pad 52 is shown atop the support platform 50. The pad 52 is made of elastomeric material and engages the bottom of an automobile with friction. This prevents the vehicle from moving forward or backward without the support platform 50.

It will be understood that the embodiments of the present invention described and illustrated herein are merely exemplary and a person skilled in the art can make many variations to the embodiments shown without departing from the scope of the present invention. For example, the described jack device is supported by three wheels. This configuration can easily be altered to have four wheels, if desired for extra stability. Furthermore, the shape of the various components, such as the rigid frame structure, primary lifting shaft and support platform can be altered into functionally equivalent forms. All such variations, modifications and alternate embodiments are intended to be included within the scope of the present invention as defined by the appended claims.

What is claimed is:

1. A jack device comprising:

an elongated lifting shaft having a first end and a second end;

at least one front wheel coupled to said first end of said shaft;

a platform connected to said second end of said shaft;

a frame structure having a first end and a second end, wherein said first end of said frame structure is coupled to said shaft at a pivot connection;

at least one rear wheel coupled to said second end of said frame structure;

a spool coupled to said at least one rear wheel, wherein said spool rotates with said at least one rear wheel; and a flexible element having one end coupled to said spool and an opposite end coupled to said shaft at a point proximate said first end of said shaft, wherein said flexible element winds around said spool when said spool turns.

2. The device according to claim 1, further including at least one spring for storing rotational energy when said rear wheels are turned.

3. The device according to claim 1, further including at least one limiting wheel supported by said frame structure that engages the ground as said frame structure approaches a vertical orientation.

4. The device according to claim 1, wherein said flexible element is selected from a group consisting of straps, chains and cables.

5. The device according to claim 1, further including a gauge for visually indicating an angle of inclination for said jack device.

6. The device according to claim 1, wherein said platform includes an engagement mechanism thereon for engaging a section of a vehicle.

7. A jack device, comprising:

a frame having a first section and a second section that are joined together at a hinged connection, wherein said first section and said second section are supported by wheels;

a spool coupled to at least one of said wheels;

a flexible element extending from said spool to an opposite point on said frame across said hinged connection, wherein said flexible element winds around said spool and pulls said first section and said second section together while being wound; and a support platform carried by said frame that is elevated as said first section of said frame and said second section of said frame move toward each other.

8. The device according to claim 7, wherein said first section of said frame is an elongated structure having a first end and a second end, wherein at least one wheel is coupled to said first end and said support platform is coupled to said second end.

9. The device according to claim 8, wherein said second section of said frame is coupled to said elongated structure with said hinged connection at a point between one third and one half the length of said elongated structure as measured from its first end.

10. The device according to claim 7, wherein said support platform is coupled to said frame at a pivot connection.

11. The device according to claim 7, further including at least one spring couple to at least one of said wheels for storing rotational energy as that wheel is rotated.

12. The device according to claim 7, further including at least one limiting wheel supported by said frame that engages the ground as said first section of said frame and said second section of said frame are drawn toward each other to within a predetermined distance.

13. The device according to claim 7, wherein said flexible element is selected from a group consisting of straps, chains and cables.

14. The device according to claim 7, further including a gauge for visually indicating an angle of inclination for said jack device.

15. The device according to claim 7, wherein said support platform includes an engagement mechanism thereon for engaging a section of a vehicle.

16. A method of elevating a vehicle, comprising the steps of:

providing a jack mechanism having wheels and a support platform, wherein the jack mechanism increases said support platform in elevation as said wheels are rolled in a forward direction and decreases said support platform in elevation as said wheels are rolled in a reverse direction;

placing said jack mechanism under a vehicle;

engaging said support platform with said vehicle;

advancing said vehicle in a forward direction, thereby causing said jack mechanism to roll forward and said support platform to elevate.

* * * * *